United States Patent [19]

Yoo et al.

[11] 4,198,291

[45] Apr. 15, 1980

[54] FLOAT-SINK SEPARATION OF COAL WITH LIQUID $SO_2$

[75] Inventors: Jin S. Yoo, South Holland; Emmett H. Burk, Glenwood, both of Ill.

[73] Assignee: Atlantic Richfield Company, Philadelphia, Pa.

[21] Appl. No.: 973,417

[22] Filed: Dec. 26, 1978

Related U.S. Application Data

[62] Division of Ser. No. 786,912, Apr. 12, 1977.

[51] Int. Cl.[2] ..... B03B 5/44

[52] U.S. Cl. ..... 209/172.5; 209/172; 299/5; 241/20; 241/1; 44/1 SR

[58] Field of Search ..... 44/1 SR, 1 R; 209/1, 209/172, 172.5; 241/20, 1; 299/4, 5, 7

[56] References Cited

U.S. PATENT DOCUMENTS

| | | | |
|---|---|---|---|
| 3,863,846 | 2/1975 | Keller et al. | 241/1 |
| 3,926,575 | 12/1975 | Meyers | 44/1 SR |
| 3,997,435 | 12/1976 | Farnum et al. | 209/1 X |
| 4,120,664 | 10/1978 | Gleim | 44/1 SR |
| 4,146,366 | 3/1979 | Keller | 241/1 X |

*Primary Examiner*—Ralph J. Hill
*Attorney, Agent, or Firm*—John B. Goodman

[57] ABSTRACT

The float-sink separation of coal from pyrite and ash in a bath of liquid $SO_2$ is disclosed. The specific gravity of the bath may adjusted by the addition of inert materials such as miscible materials or finely divided solids. Additional separation in another dense medium may be employed. The communition, conveying and mining of coal with liquid $SO_2$ is also disclosed.

3 Claims, No Drawings

FLOAT-SINK SEPARATION OF COAL WITH LIQUID $SO_2$

This is a continuation, division, of application Ser. No. 786,912, filed Apr. 12, 1977.

BACKGROUND OF THE INVENTION

The field of this invention relates to methods for breaking coal.

Coal found in the natural state generally exists as massive solid beds. According to usual coal mining procedures, the coal is broken into pieces of manageable size by the use of explosives, picks or other mechanical means, and finally removed from the coal bed mostly in the form of large lumps. These large lumps of coal are further reduced in size by breaking them down by mechanical procedures such as crushing, milling, grinding, pulverizing, etc. The degree of reduction in size is suited to the application for which the coal is to be used.

These physical methods for breaking coal, however, present certain disadvantages. For example, all of these methods are normally used in conjunction with each other and require a substantial energy expenditure including man power. Since numerous industrial processes which consume coal use the extracted product in a particulate form which requires a ½ inch top size or less, several size reduction operations can be required. Each of these subsequent processes employed for further particle size reduction requires specialized machinery and large additional expenditures of energy. In addition, such processes can produce large volumes of coal dust which is known to be hazardous due to its explosive nature and the effect on the health of workers carrying out the operations.

Another disadvantage of physical methods of reducing the particle size of coal is that the particle size of rocks and mineral impurities (for example, pyrite) can also be reduced. Size reduction of these impurities can inhibit the separation of these impurities from the coal in some physical separation procedures.

Heretofore, it has been recognized that physical methods of comminuting coal are not wholly satisfactory. For example, U.S. Pat. No. 3,870,237 to Aldrich issued Mar. 11, 1975 discloses a method for comminuting coal chemically involving treating the coal with liquid ammonia. While this method is interesting, it too presents several disadvantages. For example, the boiling point of liquid ammonia is quite low, namely, −33° C. This is a disadvantage because as the boiling point of normally gaseous liquids decreases, the liquids become more difficult to handle. Another disadvantage of ammonia is that it can react with coal. If this should occur, the treated coal would release nitrogen oxide pollutants to the atmosphere on burning.

A more desirable coal comminution process would not require physical comminution and would overcome the abovementioned disadvantages of comminution associated with ammonia.

SUMMARY OF THE INVENTION

It has now been found that treatment of coal with liquid sulfur dioxide can substantially weaken the interlayer forces in coal at natural interfaces present in the coal. The weakening of these interlayer forces is often such that the coal will fracture and collapse into smaller particles without requiring the application of physical procedures to induce mechanical stress.

DETAILED DESCRIPTION OF THE INVENTION AND ITS PREFERRED EMBODIMENTS

It has now been discovered that liquid sulfur dioxide when brought into contact with massive coal impregnates the coal structure causing a weakening of interlayer forces in the coal mass. Suitable contacting times can range from ten minutes to ten hours, preferably from twenty minutes to four hours. The most suitable contacting time will depend upon the degree of comminution desired and the coal employed. A suitable temperature for the liquid sulfur dioxide is from −10° C. to about −20° C. For many types of coal, the resulting reduction in these interlayer forces is so great that the coal mass after impregnation has almost no resistance to crushing forces. Some coals will in fact, collapse under their own weight to a finely divided product when treated with liquid sulfur dioxide.

Suitable coals which can be treated in accordance with the process of this invention include brown coal, lignite, subbituminous, bituminous (high volatile, medium volatile, and low volatile), semi-anthracite, and anthracite.

The discovery that liquid sulfur dioxide can aid in fragmenting coal has many practical benefits. For example, chemical comminution of coal with sulfur dioxide can be used in a new process for mining coal. The process is suitable for deep-mining, strip-mining and auger-mining in that the coal after being comminuted by liquid sulfur dioxide, with or without the use of mechanical aids, can then be extracted and carried from the coal bed.

For example, coal can be mined from sub-surface strata by injecting liquid sulfur dioxide into a sub-surface stratum, following this with the injection of a suitable fluid at a rate high enough to form a suspension, and carrying the suspension back to the surface where the comminuted coal is separated from the carrier. A suitable fluid can be nitrogen gas, gaseous sulfur dioxide or liquid sulfur dioxide. Since exposure to sulfur dioxide fragments only coal, large rocks and other mineral masses will not brought to the surface. The result can be a cleaner mined coal product than that provided by conventional mining methods.

In yet another application, liquid sulfur dioxide can be used to treat chunks of coal to provide coal particles of smaller sizes as required in industrial applications.

As is well known, raw coals contain varying amounts of moisture. In the course of comminution with liquid sulfur dioxide, a portion of this moisture will be lost to the sulfur dioxide. Starting with essentially anhydrous sulfur dioxide, the water content of the sulfur dioxide after treating successive batches of coal will rise. When the water content of the sulfur dioxide reaches a level such that the rate kinetics are judged uneconomic, the sulfur dioxide can be separated from the water by known means and reused.

A particularly useful aspect of comminution of coal with liquid sulfur dioxide involves reducing the sulfur content of the coal. Processes for physically cleaning coal to separate pyritic sulfur from coal are well known. These known processes generally involve physically crushing coal to a fine particle size, and then employing processes when can effect a separation of coal particles and pyrite particles based on their varying densities.

There are several advantages in using sulfur dioxide to reduce the coal particle size instead of physical crushing in such a coal cleaning process. For example, elemental sulfur is soluble in liquid sulfur dioxide. Therefore, the use of liquid sulfur dioxide can reduce the amount of this form of sulfur in coal. Liquid sulfur dioxide will not reduce the particle size of pyrites, whereas crushing may reduce the particle size of pyrites. This aids separation of pyrite and coal particles. In addition, liquid sulfur dioxide is a dense medium having a specific gravity of 1.410. The result is that the communited coal particles which generally have a lower specific gravity than pyrite particles will tend to "float" whereas the pyritic particles and the ash portions will tend to "sink". This float-sink phenomena can be employed to effect a partial separation of pyrite and coal during comminution with liquid sulfur dioxide. In a preferred method for separating coal from ash and pyrite particles in liquid sulfur dioxide, the specific gravity of the liquid sulfur dioxide is adjusted in response to the particular coal to effect the best possible physical separation. The specific gravity of the sulfur dioxide liquid can be adjusted by adding an inert material (a miscible material or finely divided solid) to the liquid sulfur dioxide. Generally a specific gravity of from 1.4 to 2.0, and more generally 1.5 to 1.8, will be employed to effect good float-sink separations. As will be recognized by those skilled in the art, the effectiveness of such a dense medium separation will vary depending upon the characteristics of the coal employed.

Of course, additional separation steps can, and preferably will, be employed. For example, another dense medium separation step employing another dense medium, for example, a halocarbon liquid, or an aqueous slurry of fine magnetite particles, can be used to effect a further separation of coal from ash and pyrite. In some coals, it has been observed that the float portion of the coal comminuted with liquid sulfur dioxide will also exhibit a lower organic sulfur content.

The following examples illustrate the effectiveness of treating coal with liquid sulfur dioxide to comminute coal.

EXAMPLES 1-8

Eight different types of coal were treated with liquid sulfur dioxide in the following manner.

Chunks of each coal type with sizes ranging from 2 to 4 inches were charged to a flask. An amount of liquid sulfur dioxide sufficient to submerge the coal was charged to the flask. After a short contact period of 5 to 10 minutes, many of the coal chunks began to fracture and collapse. During this process, it was observed that with several coal types, a float-sink occurs, i.e., coal particles tended to float whereas ash and pyrite particles tended to sink. (A float-sink separation was made directly from the liquid sulfur dioxide in Example 8 below). The various coals were maintained in contact with liquid $SO_2$ for the period of time indicated. The liquid sulfur dioxide was then separated from communited coal particles and the communited coal product was dried overnight at 50° C.

In Examples 1-7 each of the chemically comminuted coal products was then subjected to a float-sink separation in carbon tetrachloride.

The results for the various coals tested are shown below.

| | | | Percent by Weight Sulfur DAF | | | | | |
|---|---|---|---|---|---|---|---|---|
| | | Wt. % | T.S. | S.S. | P.S. | O.S. | Percent by Weight Ash | Medium |
| Example 1 | | | | | | | | |
| Coal: Upper Freeport Seam Grantsville, Md. Float/Sink Separation | Contact Time: 2 hours | | | | | | | |
| Float Portion | | 72 | 1.67 | 0.60 | 0.42 | 0.65 | 12.20 | Carbon Tetrachloride |
| Sink Portion | | 28 | 6.36 | 0.55 | 4.87 | 0.93 | 54.4 | |
| Example 2 | | | | | | | | |
| Coal: Upper Freeport, W.Va., BM No. 366 Float/Sink Separation | Contact Time: 3 hours | | | | | | | |
| Float Portion | | 82 | 1.81 | 0.40 | 0.48 | 0.93 | 9.84 | Carbon Tetrachloride |
| Sink Portion | | 18 | 4.23 | 0.44 | 3.21 | 0.58 | 25.5 | |
| Example 3 | | | | | | | | |
| Coal: Pittsburgh Coal Bed, Belmont County, Ohio BM No. 440 Float/Sink Separation | Contact Time: 1.5 hours | | | | | | | |
| Float Portion | | 86 | 5.62 | 0.33 | 1.77 | 3.52 | 8.73 | Carbon Tetrachloride |
| Sink Portion | | 14 | 56.87 | 1.27 | 41.90 | 13.76 | 50.6 | |
| Example 4 | | | | | | | | |
| Coal: Lucinda, Pa., Zocherl Coal Company Float/Sink Separation | Contact Time: 10 hours | | | | | | | |
| Float Portion | | 92 | 3.08 | 0.12 | 1.23 | 1.73 | 5.29 | Carbon Tetrachloride |
| Sink Portion | | 8 | 54.11 | 1.23 | 48.9 | 3.41 | 44.0 | |
| Example 5 | | | | | | | | |
| Coal: Ohio Clarion #4 Seam, Meigs County Float/Sink Separation | Contact Time: 2.0 hours | | | | | | | |
| Float Portion | | 92 | 3.71 | 0.37 | 0.64 | 2.70 | 5.23 | Carbon Tetrachloride |
| Sink Portion | | 8 | 29.58 | 0.70 | 23.83 | 4.69 | 37.4 | |
| Example 6 | | | | | | | | |
| Coal: Palistine Ohio, | Contact Time: *5.0 hours | | | | | | | |

-continued

| | | Wt. % | Percent by Weight Sulfur DAF T.S. | S.S. | P.S. | O.S. | Percent by Weight Ash | Medium |
|---|---|---|---|---|---|---|---|---|
| Ferris Coal Co. | **2.0 hours | | | | | | | |
| Float/Sink Separation | | | | | | | | |
| Float Portion* | | 95 | 3.87 | 1.20 | 1.69 | 0.98 | 7.78 | Carbon Tetrachloride |
| Sink Portion | | 5 | 32.18 | 1.90 | 9.11 | 4.62 | 39.4 | |
| Float Portion** | | 96 | 2.66 | 0.24 | 1.20 | 2.26 | 4.40 | |
| Sink Portion | | 4 | 54.0 | 2.40 | 44.36 | 7.27 | 45.0 | |
| Example 7 | | | | | | | | |
| Coal: Kentucky, Ohio County BM No. 367 | Contact Time: 4 hours | | | | | | | |
| Float/Sink Separation | | | | | | | | |
| Float Portion | | 98 | 3.11 | 1.19 | 0.87 | 1.05 | 4.40 | Carbon Tetrachloride |
| Sink Portion | | 2 | 29.0 | 2.67 | 22.82 | 3.60 | 37.7 | |
| Example 8 | | | | | | | | |
| Coal: Pennsylvania, Pittsburgh BM No. 387 | Contact Time: 4 hours | | | | | | | |
| Float/Sink Separation | | | | | | | | |
| Float Portion | | 93 | 3.32 | 0.04 | 1.18 | 1.30 | 13.3 | Liquid Sulfur Dioxide |
| Sink Portion | | 7 | 9.50 | 1.37 | 6.09 | 2.02 | 41.9 | |

In the foregoing Examples 1 to 8, DAF means dry ash-free basis, T.S. means total sulfur, S.S. means sulfate sulfur, P.S. means pyritic sulfur, O.S. means organic sulfur and BM means Bureau of Mines.

In all of the above Examples, significant comminution resulted from the treatment with liquid sulfur dioxide. As seen in the above Examples this comminution can be useful in that the resulting coal product can be subjected to a float-sink separation procedure to remove substantial amounts of pyritic sulfur and ash from coal.

A particle size analysis was made of the float portion of the comminuted product of Examples 6 and 8. The results are presented in Table I below.

TABLE I

| Comminuted Coal Size, μ | 1000+ | 500–1000 | 250–500 | 125–250 | 63–125 | 38–63 | 38– |
|---|---|---|---|---|---|---|---|
| Example 6 Wt. % | 31.20 | 31.67 | 23.11 | 9.38 | 3.09 | 1.21 | 0.34 |
| Example 8 Wt. % | 15.67 | 24.23 | 23.18 | 17.89 | 17.10 | 0.43 | 0.40 |

While this invention has been described with respect to various specific examples and embodiments, it is to be understood that the invention is not limited thereto and that it can be variously practiced within the scope of the following claims.

What is claimed is:

1. A method for cleaning coal comprising
(a) submerging coal containing ash and pyrite in liquid sulfur dioxide for a time sufficient for a discrete float-sink separation to occur, and
(b) recovering the float portion, a coal product reduced in ash and pyrite.

2. The method of claim 1 wherein the specific gravity of the liquid sulfur dioxide is adjusted by the addition of a quantity of an inert material to effect an improved float-sink separation of coal from ash and pyrite.

3. The method of claim 1 wherein coal is submerged for a period of from ten minutes to ten hours.

* * * * *